US011000164B2

(12) United States Patent
Shanahan et al.

(10) Patent No.: US 11,000,164 B2
(45) Date of Patent: May 11, 2021

(54) WIPE DISPENSING

(71) Applicant: ionogen Inc., Knoxville, TN (US)

(72) Inventors: John Patrick Shanahan, Knoxville, TN (US); Christopher Harold King, Fayetteville, GA (US)

(73) Assignee: ionogen Inc., Knoxville, TN (US)

( * ) Notice: Subject to any disclaimer, the term of this patent is extended or adjusted under 35 U.S.C. 154(b) by 289 days.

(21) Appl. No.: 16/262,213

(22) Filed: Jan. 30, 2019

(65) Prior Publication Data

US 2019/0231151 A1 Aug. 1, 2019

Related U.S. Application Data

(60) Provisional application No. 62/623,590, filed on Jan. 30, 2018.

(51) Int. Cl.

| | |
|---|---|
| ***A47K 10/38*** | (2006.01) |
| *A47K 10/32* | (2006.01) |
| *B65D 83/08* | (2006.01) |

(52) U.S. Cl.

CPC .. *A47K 10/3827* (2013.01); *A47K 2010/3286* (2013.01); *B65D 83/0835* (2013.01)

(58) Field of Classification Search

CPC ..... A47K 10/3827; A47K 10/3818; A47K 10/421; A47K 2010/3253; A47K 2010/3266; A47K 2010/3286; B65D 83/0835

See application file for complete search history.

(56) References Cited

U.S. PATENT DOCUMENTS

| | | | | |
|---|---|---|---|---|
| 2,308,168 A * | 1/1943 | Garson | ..... | A47K 10/38 118/419 |
| 3,592,161 A * | 7/1971 | Hoffmann | ..... | A47K 10/38 118/122 |
| 3,947,134 A * | 3/1976 | Ogawa | ..... | A47K 10/32 401/118 |

(Continued)

FOREIGN PATENT DOCUMENTS

| | | |
|---|---|---|
| AT | 003361 U1 | 2/2000 |
| KR | 200402751 | 12/2005 |
| KR | 100822833 | 4/2008 |

OTHER PUBLICATIONS

International Search Report and Written Opinion for PCT/US201943696 dated Dec. 3, 2019 (20 pages).

(Continued)

*Primary Examiner* — Michael E Gallion

(74) *Attorney, Agent, or Firm* — Merchant & Gould P.C.; Daniel R. Evans

(57) ABSTRACT

Devices, systems, and methods of the present disclosure are directed to dispensing wipes that are treated as the wipes move through a housing of a dispenser. Such in situ treatment of the wipes may facilitate, for example, achieving control over one or more of the concentration, composition, or distribution of one or more chemicals carried by the wipes. Further, or instead, the one or more chemicals may be formed within the housing (e.g., just prior to treating the wipes), which may be useful for treating the wipes with chemicals that have limited stability and/or for reducing chemical handling requirements along a supply chain.

18 Claims, 10 Drawing Sheets

(56) References Cited

U.S. PATENT DOCUMENTS

| | | | | |
|---|---|---|---|---|
| 4,041,900 | A * | 8/1977 | Charles | A47K 10/32 118/419 |
| 5,660,636 | A * | 8/1997 | Shangold | A47K 10/32 118/419 |
| 6,346,153 | B1 * | 2/2002 | Lake | A47K 10/32 118/419 |
| 6,547,881 | B1 * | 4/2003 | Klockner | A47K 10/32 118/264 |
| 8,287,702 | B2 * | 10/2012 | Gomez | A61L 2/035 204/272 |
| 9,309,601 | B2 | 4/2016 | Shanahan et al. | |
| 2005/0211735 | A1 | 9/2005 | Socier | |
| 2005/0274729 | A1 | 12/2005 | Bushman et al. | |
| 2007/0081803 | A1 * | 4/2007 | Lindsay | A47K 10/32 392/392 |
| 2007/0278242 | A1 | 12/2007 | Amundson | |
| 2009/0065521 | A1 | 3/2009 | Amundson | |
| 2009/0071844 | A1 | 3/2009 | Gomez | |
| 2010/0032443 | A1 * | 2/2010 | Mueller | A45D 34/00 221/2 |
| 2012/0175455 | A1 | 7/2012 | Denis et al. | |
| 2012/0248136 | A1 * | 10/2012 | Meyers | A61L 2/22 221/96 |
| 2016/0024667 | A1 | 1/2016 | Shanahan et al. | |
| 2016/0174779 | A1 * | 6/2016 | Yaros | A47K 10/38 242/594 |
| 2018/0230413 | A1 * | 8/2018 | Joshi | A61L 2/186 |
| 2019/0343345 | A1 * | 11/2019 | Shanahan | A47K 10/3687 |

OTHER PUBLICATIONS

International Search Report and Written Opinion for PCT/US2019/015809 dated May 15, 2019 (32 pages).

* cited by examiner

WIPE DISPENSING

CROSS-REFERENCE TO RELATED APPLICATIONS

This application claims priority to U.S. Provisional Patent Application No. 62/623,590, filed on Jan. 30, 2018, the entire contents of which are incorporated herein by reference.

BACKGROUND

Dispensers are commonly used to dispense handheld wipes that are pre-wet with chemicals for various cleaning applications. While convenient, the chemicals used to pre-wet these wipes are typically limited to stable chemical solutions or the like that are shelf-stable, and can be stored in a container with the wipes prior to use. There remains a need for dispensers that treat wipes with customized chemical formulations as needed, e.g., as the wipes are dispensed from a container.

SUMMARY

Wipes are treated with active agents such as cleansers, sanitizers, solvents or the like as they are dispensed from a container. This permits dynamic control of the concentration, composition, or distribution of active agents within the wipes at the time they are dispensed. The active agents may also usefully be formed within the housing at the time of use, advantageously permitting the formation of wipes with chemicals that have limited stability or longevity.

In an aspect, a method for dispensing treated wipes disclosed herein may include providing a source of a contiguous arrangement of wipes in a housing, the wipes sequentially engaged with one another in the contiguous arrangement and the wipes formed of an absorbent material, activating a liquid in a reservoir defined by the housing to form the liquid into an activated fluid, and drawing at least one portion of the contiguous arrangement of the wipes through the activated fluid in the reservoir.

Implementations may include one or more of the following features. The activated fluid may be at least one of a sanitizing solution and a disinfecting solution. Activating the liquid in the reservoir may include electrochemically activating the liquid to form the activated fluid. Electrochemically activating the liquid may include providing a flow of electricity through the liquid in the reservoir. Providing the flow of electricity through the liquid in the reservoir may include pulsing the flow of electricity through the liquid in the reservoir. The liquid in the reservoir may be an aqueous solution including at least one salt, and electrochemically activating the liquid in the reservoir may include an electrolysis reaction. Activating the liquid may include exposing the liquid to a second liquid carried on the at least one portion of the contiguous arrangement of wipes drawn through the liquid. The source of the contiguous arrangement of the wipes may be supported in a position outside of the liquid, and at least one portion of the contiguous arrangement of the wipes may be drawn through the liquid from the position outside of the liquid. Drawing at least one portion of the contiguous arrangement of the wipes through the activated fluid may include pulling an end portion of the contiguous arrangement of the wipes through an opening defined by the housing. Pulling the end portion of the contiguous arrangement of the wipes through the opening may squeeze at least one portion of the contiguous arrangement to remove an excess amount of the activated fluid from the at least one portion of the contiguous arrangement.

In an aspect, a system for dispensing treated wipes disclosed herein may include a housing defining a chamber, a reservoir, and an opening. The system may also include a source of a contiguous arrangement of wipes in the chamber, a liquid in the reservoir, an electrode system including a plurality of spaced apart electrodes within the reservoir and positioned relative to one another to facilitate a flow of electricity through the liquid to form an activated fluid, a controller coupled to the electrode system and configured to provide the flow of electricity between the plurality of spaced apart electrodes to form the activated fluid, and one or more guide surfaces arranged to guide the contiguous arrangement of wipes from the source in the chamber, through the liquid in the reservoir, and out of the housing via the opening.

Implementations may include one or more of the following features. The source of the contiguous arrangement of the wipes may include one or more of a roll or a stack of the wipes. The contiguous arrangement of wipes may be perforated at intervals along a length of the contiguous arrangement of wipes. The system may further include one or more sensors, the one or more sensors in fluid communication with the liquid in the reservoir, and the controller configured to control a power driven between the plurality of spaced apart electrodes based on feedback from the one or more sensors. The controller may be configured to pulse the power driven between the plurality of spaced apart electrodes. The plurality of spaced apart electrodes may be spaced at a fixed distance relative to one another. One or more guide surfaces may extend below the liquid in the reservoir. One or more guide surfaces may include a roller, where the contiguous arrangement of wipes is threaded in tension around the roller, and the roller is rotatable as the contiguous arrangement of wipes moves through the liquid in the reservoir. One or more guide surfaces may include an arm biased against the contiguous arrangement of wipes to squeeze an excess of the activated fluid from the contiguous arrangement of wipes moving out of the reservoir.

In an aspect, a system for dispensing treated wipes disclosed herein may include a housing defining a chamber, a reservoir, and an opening. The system may also include a source of a contiguous arrangement of wipes in the chamber, a liquid in the reservoir, and one or more guide surfaces arranged to define a nonlinear path along which the contiguous arrangement of the wipes is movable from the source in the chamber, through the liquid in the reservoir, and out of the housing via the opening through an application of tension to an end portion of the contiguous arrangement of wipes extending through the opening.

In an aspect, a chamber for a multi-chamber wipes dispenser disclosed herein may include a lower chamber sized to receive a roll or stack of wipes that are fed into a separate, upper chamber, where the upper chamber may include a roller under which the wipes are threaded in order to ensure soaking of the wipes in a solution that is disposed in the upper chamber. The chamber may further include an opening through which the wipes are dispensed.

Implementations may include one or more of the following features. The wipes may be fed into the upper chamber over a lip of the upper chamber. The wipes may be fed into the upper chamber through a sidewall of the upper chamber. The opening may be lined with a thermoplastic elastomer to remove excess liquid. The chamber may be adapted to receive an electrochemical activation apparatus. The electrochemical activation apparatus may be in electrical communication with a battery of a base that receives the chamber. The chamber itself may be an electrochemical activation apparatus. The electrochemical activation apparatus may be in electrical communication with a battery of a base that receives the chamber.

BRIEF DESCRIPTION OF THE FIGURES

The foregoing and other objects, features and advantages of the devices, systems, and methods described herein will be apparent from the following description of particular embodiments thereof, as illustrated in the accompanying drawings. The drawings are not necessarily to scale, emphasis instead being placed upon illustrating the principles of the devices, systems, and methods described herein.

DETAILED DESCRIPTION

Figure 1A:
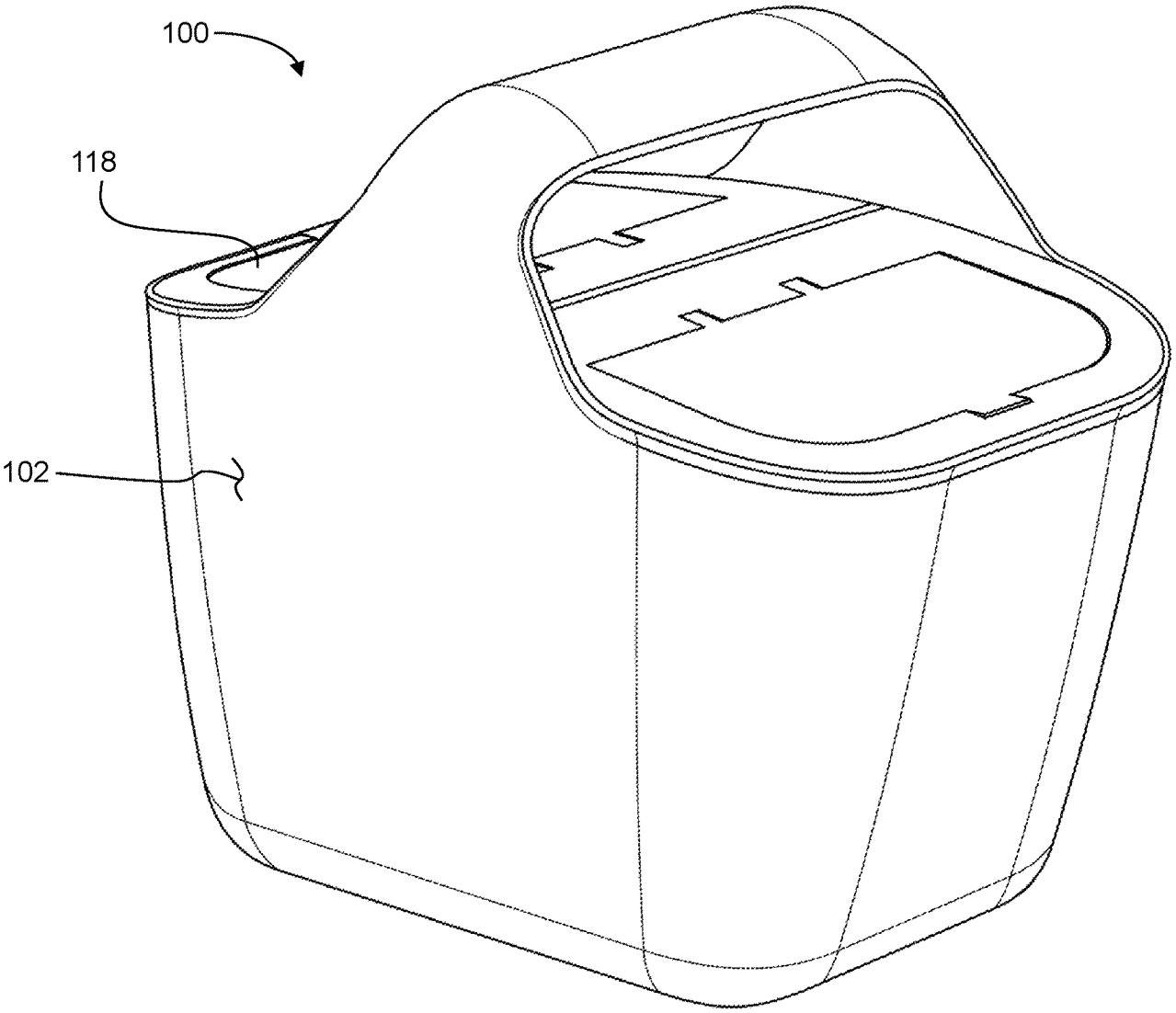
FIG. 1A is a perspective view of a dispenser with lids closed.
Figure 1B:
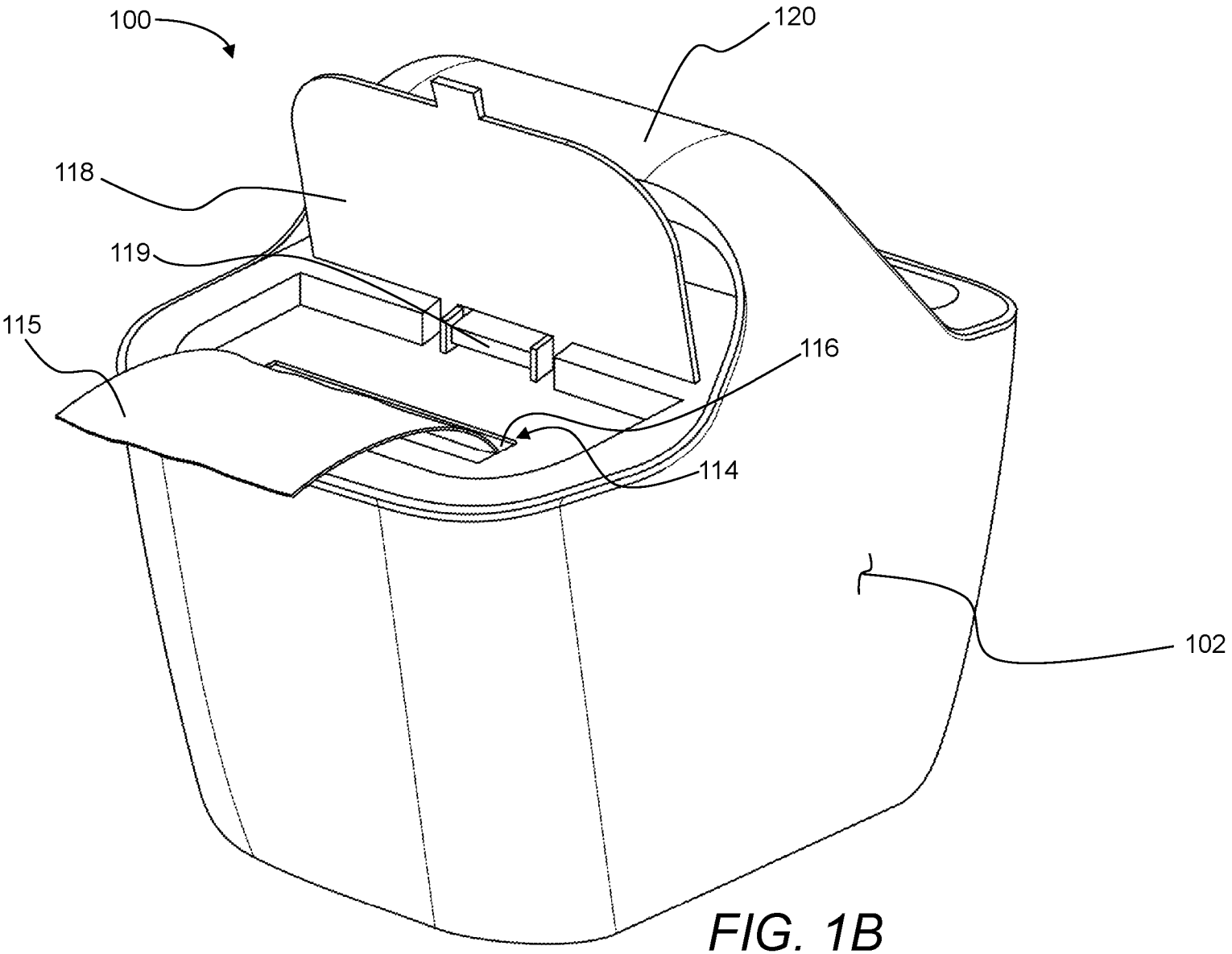
FIG. 1B is a perspective view of the dispenser of FIG. 1A with one lid open.
Figure 1C:
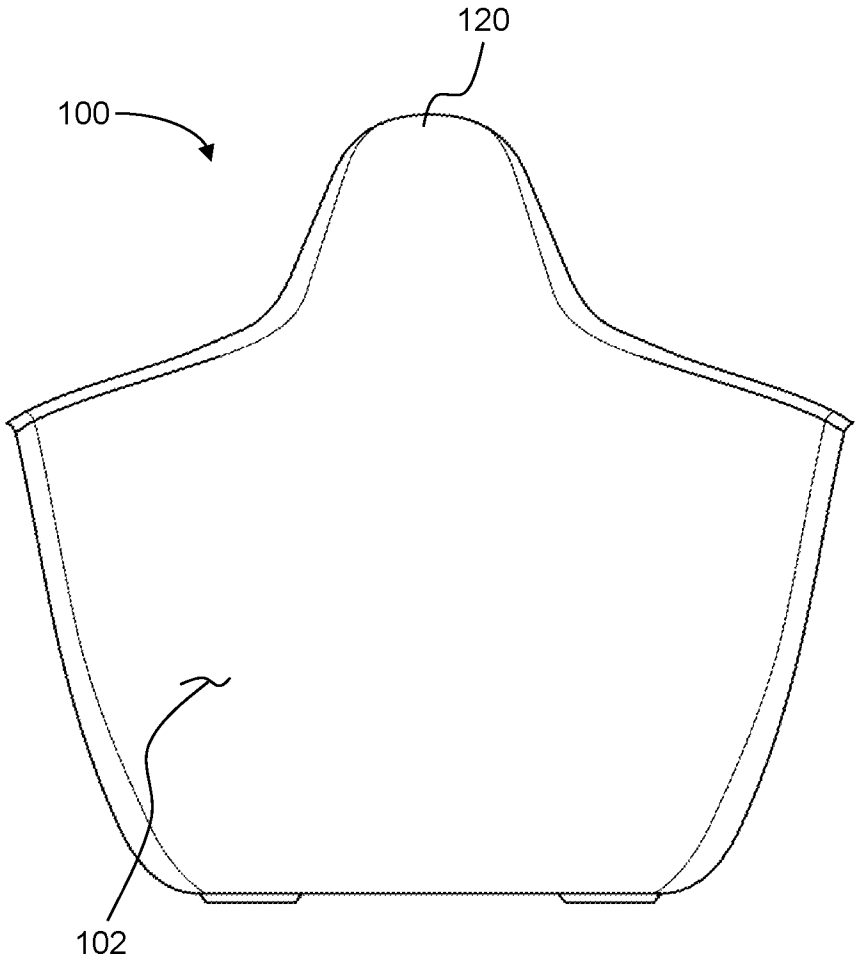
FIG. 1C is a side view of the dispenser of FIG. 1A.
Figure 1D:
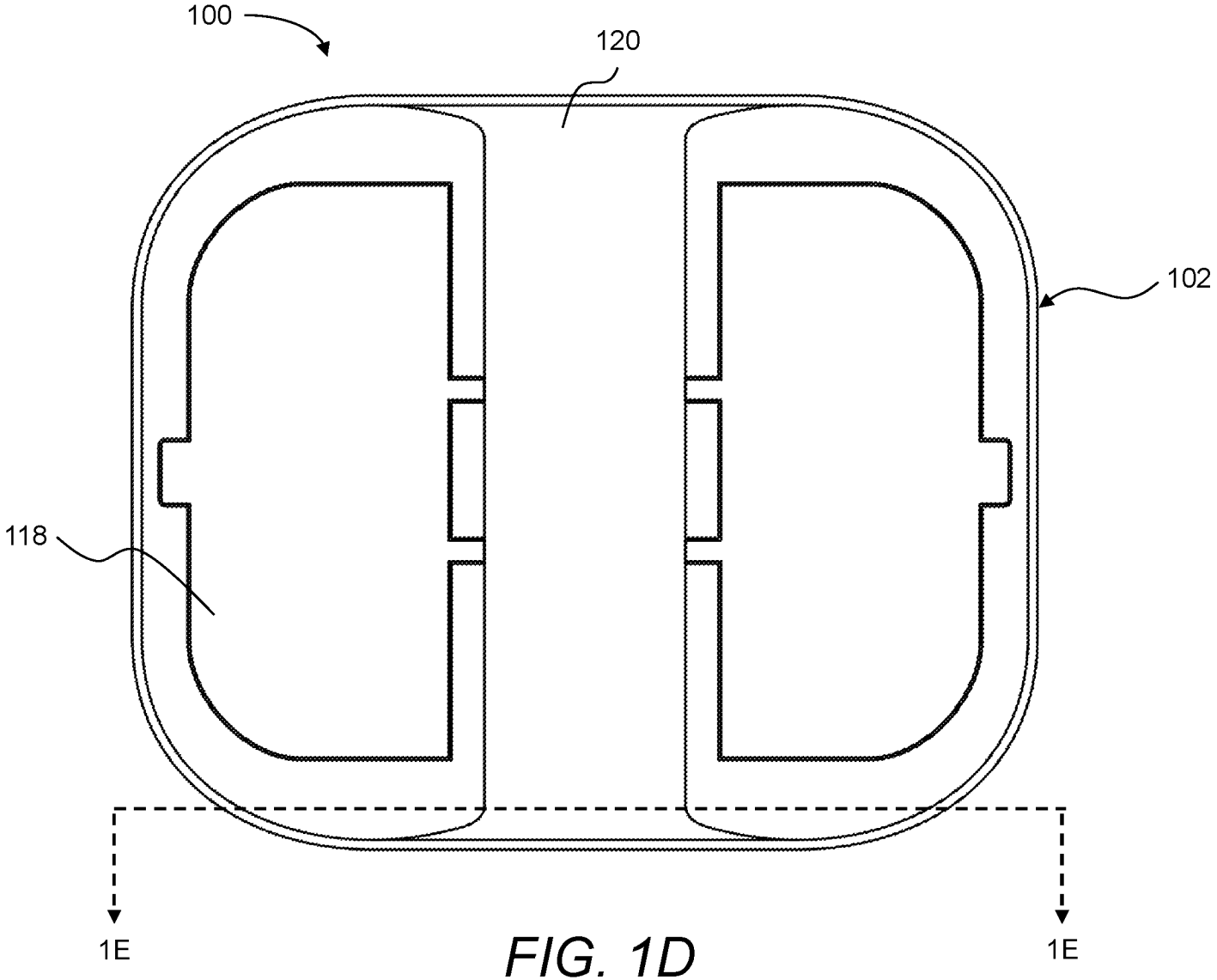
FIG. 1D is a top view of the dispenser of FIG. 1A.
Figure 1E:
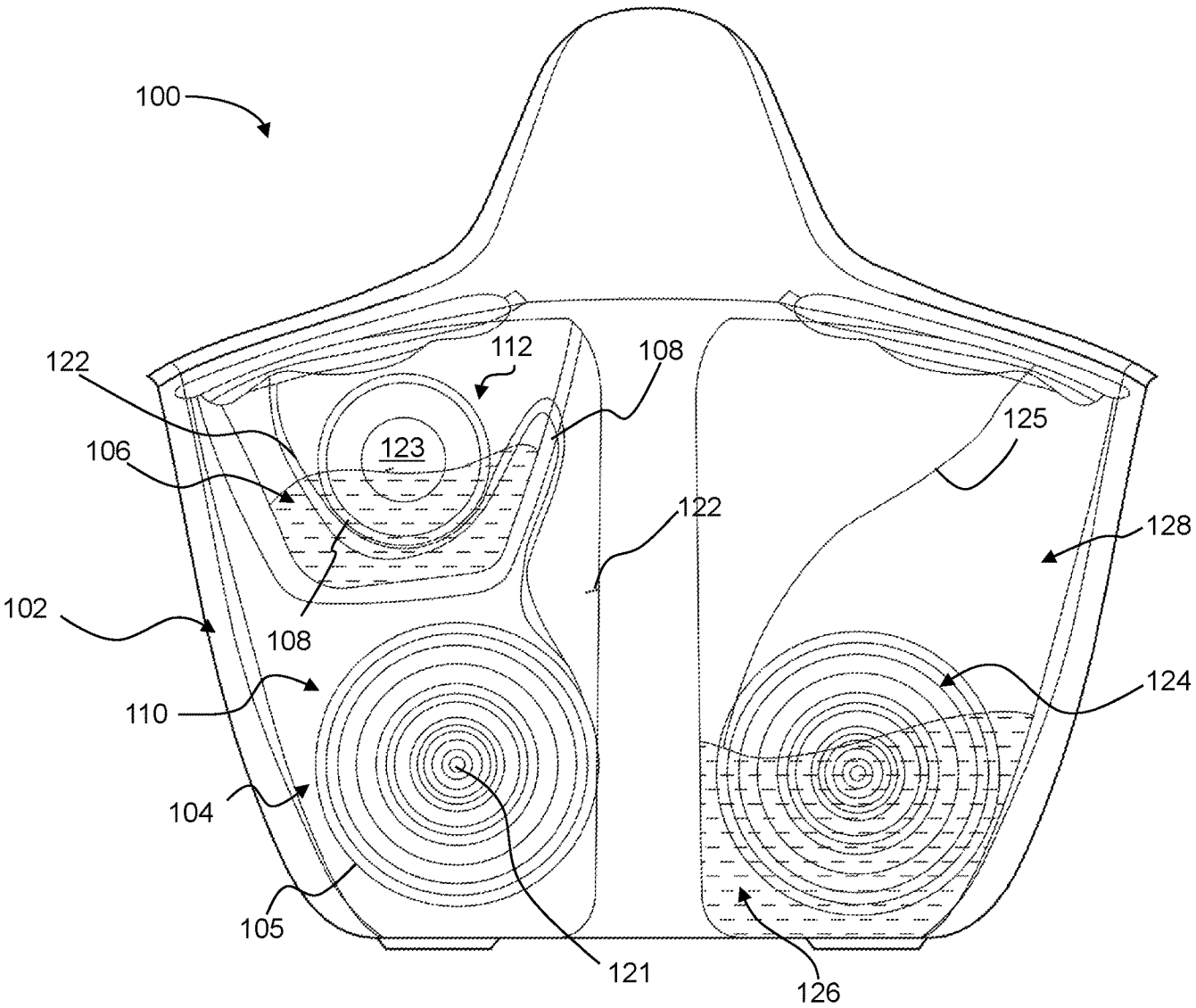
FIG. 1E is a cross-sectional side view of the dispenser of FIG. 1A taken along line 1E-1E in FIG. 1D.

Embodiments will now be described with reference to the accompanying figures, in which preferred embodiments are shown. The foregoing may, however, be embodied in many different forms and should not be construed as limited to the illustrated embodiments set forth herein.

All documents mentioned herein are hereby incorporated by reference in their entirety. References to items in the singular should be understood to include items in the plural, and vice versa, unless explicitly stated otherwise or clear from the context. Grammatical conjunctions are intended to express any and all disjunctive and conjunctive combinations of conjoined clauses, sentences, words, and the like, unless otherwise stated or clear from the context. Thus, unless otherwise indicated or made clear from the context, the term "or" should generally be understood to mean "and/or" and, similarly, the term "and" should generally be understood to mean "and/or."

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the embodiments.

In the following description, it is understood that terms such as "first," "second," "third," "above," "below," and the like, are words of convenience and are not to be construed as implying a chronological order or otherwise limiting any corresponding element unless expressly state otherwise.

As used herein, the term "wipe" should be understood to refer generally to any manner and form of planar sheet (including folded sheets, rolled sheets, and so forth) that may be treated with one or more chemicals and dispensed for use in applying the one or more chemicals (also referred to herein as "active agents") to a target surface, e.g., for cleaning, disinfecting, polishing, or otherwise treating or the like. For example, a wipe may include one or more absorbent materials that retain the one or more chemicals when dispensed and that subsequently release the one or more chemicals as the absorbent material is wiped along the target surface. In some instances, the absorbent material may include a fabric (e.g., a woven fabric, a non-woven fabric, or a combination thereof) having fibers that are wettable with the one or more chemicals. As an example, in instances in which the one or more chemicals are in an aqueous solution, the fibers may be hydrophilic to facilitate absorbing the one or more chemicals.

As also used herein, unless otherwise specified or made clear from the context, a contiguous arrangement of wipes should be understood to refer to any manner and form of aggregation of a plurality of wipes adjacent to one another. For example, in a contiguous arrangement, the wipes may be connected to one another in an end-to-end relationship with individual instances of the wipes delineated from one another by perforations, or other similar areas of weakness, along which an individual instance of the wipes may be torn from the remaining instances of the wipes in the contiguous arrangement of wipes. Further, or instead, the contiguous arrangement of wipes may have any one or more of various different form factors, as may be suitable for a given implementation. Thus, for example, the contiguous arrangement of wipes may be in the form of a roll. Additionally, or alternatively, the contiguous arrangement of wipes may be in the form of a stack in which the instances of the wipes are coupled end-to-end, or otherwise folded or pressed into engagement with one another, and folded on top of one another in a "Z" pattern (this arrangement is sometimes referred to herein as a "Z" stack).

In the description that follows, the term "housing" should be understood to include any walls of a dispenser defining one or more internal volumes of the dispenser and, generally, separating the one or more internal volumes from one another and/or from an external environment. One or more portions of the housing may, but need not, be stationary with respect to one another. Thus, for example, the housing may include one or more lids that may be open and closed, as may be useful for protecting materials stored within the housing, or preventing spills or evaporation. Further, or instead, as described in greater detail below, the housing may be modular in certain instances, with sections of the housing removable to facilitate replacement of depleted supplies and/or to permit customized configuration of the dispenser for a given application. For the sake of clarity and efficiency of explanation, the housings described herein are generally described as having two sections. This is an informative use case for explaining how different wipe treatments may be carried out in a single dispenser—with a particularly advantageous configuration including formation of cleaning wipes and sanitizing wipes in the same dispenser. However, it should be appreciated that, unless otherwise expressly indicated or made clear from the context, any one or more of the housings described herein may have any number of sections without departing from the scope of the present disclosure. Specifically, any one or more of the housings described herein may have a single section for carrying out a single treatment of wipes. Further, or instead, any one or more of the housings described herein may have more than two sections for carrying out a corresponding number of treatments of wipes.

Referring now to FIGS. 1A-1E, a dispenser 100 may include a housing 102, a first source 104 of a first contiguous arrangement of wipes 105, a first liquid 106, and one or more guide surfaces 108. The housing 102 may define a chamber 110, a first reservoir 112, and a first opening 114. The first source 104 of the first contiguous arrangement of wipes 105 may be disposed in the chamber 110, and the first liquid 106 may be disposed in the first reservoir 112.

In use, the first contiguous arrangement of wipes 105 may be drawn from the first source 104 in the chamber 110, through the first liquid 106 in the first reservoir 112, and out of the housing 102, via the first opening 114, through the application of tension to an end portion 115 of the first contiguous arrangement of wipes 105 extending through the first opening 114. Each portion of the first contiguous arrangement of wipes 105 drawn through the first liquid 106 in this way may absorb the first liquid 106 in the first reservoir 112 just prior to being pulled through the first opening 114 for use. As a significant advantage, this local introduction of the first liquid 106 into the first contiguous arrangement of wipes 105 facilitates wetting of the first contiguous arrangement of wipes 105 with one or more chemicals that are not typically available or suitable for use in pre-wet wipes, e.g., because they are not shelf stable. Further, or instead, as compared to pre-wet wipes stored for a long period of time, introduction of the first liquid 106 into the first contiguous arrangement of wipes 105 just prior to use may increase the likelihood that the first liquid 106 has suitable chemical activity as the end portion 115 is separated from the first contiguous arrangement of wipes 105 and wiped onto a surface.

In general, the housing 102 may define the chamber 110 and the first reservoir 112 in any of various different orientations relative to one another such that the first source 104 of the first contiguous arrangement of wipes 105 is stored away from the first liquid 106 in the first reservoir 112. For example, the chamber 110 may be below the first reservoir 112, which may be useful facilitating refilling the first reservoir 112 without needing to remove the first contiguous arrangement of wipes 105. However, as described in greater detail below, certain implementations may advantageously include a chamber above a reservoir. In any event, the first contiguous arrangement of wipes 105 may be coupled from the first source 104 to the end portion 115 along a feedpath through the first liquid 106 to permit on-demand wetting of the wipes 105 as they are dispensed. The feedpath may generally include any path guided along rollers, guide surfaces and so forth to draw the wipes 105 through the first liquid 106, and/or to impose sufficient tension, wiping or the like to remove excess liquid from the wipes 105 prior to dispensing and use.

The housing 102 may, generally, retain the shape of the chamber 110 and the first reservoir 112 as the first contiguous arrangement of wipes 105 move along the one or more guide surfaces 108 through the application of tension applied to the end portion 115 of the first contiguous arrangement of wipes 105. Additionally, or alternatively, the housing 102 may be formed of a material that may be readily cleaned and/or having antimicrobial properties such that formulations of the first liquid 106 may be changed with little or no risk of contamination. Further, or instead, at least a portion of the housing 102 defining the first reservoir 112 may be formed of a material resistant to corrosion or other chemical reaction with the first liquid 106. Thus, for example, the housing 102 may be formed of one or more rigid materials (e.g., a hard plastic, metal, or a combination thereof).

The first opening 114 defined by the housing 102 may be any of various different shapes suitable for creating a degree of frictional engagement with the end portion 115 of the first contiguous arrangement of wipes 105. As should be generally appreciated, an appropriate degree of frictional engagement imparted to the end portion 115 may be a function of competing considerations associated with pulling the end portion 115 through the first opening 114. That is, the first opening 114 may be sized relative to the first contiguous arrangement of wipes 105 such that friction between the housing 102 at the first opening 114 and the end portion 115 of the first contiguous arrangement of wipes 105 is at least large enough to hold the end portion 115 of the first contiguous arrangement of wipes 105 in place when tension is not applied, thus reducing the likelihood that the end portion 115 will inadvertently retract into the first reservoir 112. Further, the first opening 114 may be sized relative to the first contiguous arrangement of wipes 105 such that friction between the housing 102 at the first opening 114 and the end portion 115 is small enough to allow the end portion 115 to be pulled through the first opening 114 with little or no risk of inadvertent tearing. Thus, as a specific example, the first opening 114 may be an elongate slit having a width and thickness approximately equal to the respective width and thickness of the first contiguous arrangement of wipes 105. As described in greater detail below, other shapes of the first opening 114 may further or instead be useful. In general, the wipes 105 may also be coupled to one another with sufficient mechanical tenacity to facilitate dispensation along the feedpath to the first opening 114, while also permitting a user to easily separate one of the wipes 105 (e.g., a "sheet") after the sheet is withdrawn through the first opening 114.

While the housing 102 may be generally rigid along the chamber 110 and the first reservoir 112, the housing 102 may include a skirt 116 defining the first opening 114. The skirt 116 may be formed of a flexible material (e.g., one or more of a thermoplastic material or other synthetic or natural material) and, in some cases, may engage portions of the first contiguous arrangement of wipes 105 moving through the first opening 114. Through such engagement, the skirt 116 may act as a squeegee or press to remove excess amounts of the first liquid from a sheet of the first contiguous arrangement of wipes 105 moving through the first opening 114.

In certain implementations, the housing 102 may include a first lid 118 movable between open and closed positions. For example, the first lid 118 may reduce the likelihood of spilling and/or contaminating the first liquid 106 between uses while providing access to the end portion 115 of the first contiguous arrangement of wipes 105 during use. The first lid 118 may, for example, snap into place in the closed position to facilitate transporting the dispenser 100 with the first lid 118 in the closed position. In some instances, the first lid 118 may include a first hinge 119. As an example, the first hinge 119 may be spring loaded such that the first hinge 119 is biased toward the closed position of the first lid 118 to increase the likelihood that the first lid 118 will be closed between uses.

In some instances, the housing 102 may include a handle 120 graspable by a user (e.g., using a neutral grip) to facilitate transportation and use of the dispenser 100. That is, it may be desirable to maintain the dispenser 100 in a fixed orientation to reduce the likelihood that the first liquid 106 in the first reservoir 112 will spill and prematurely wet the first contiguous arrangement of wipes 105. By providing a secure gripping surface with the dispenser 100 in the proper orientation, the handle 120 may reduce the likelihood that a user inadvertently tilts the dispenser 100 in an undesirable orientation. It should be understood that the handle 120 may be foldable or detachable to accommodate different storage and use solutions. Further, or instead, while the dispenser 100 may be sized according to a form factor amenable to being carried by a user, it should be appreciated that the dispenser 100 may be sized according to other form factors in which a handle has limited utility. For example, the dispenser 100 may be formed into a larger container having an overall weight more suitable for a stationary or rolling/wheeled installation.

The housing 102, in some instances, may include a support 121 disposed along the chamber 110 to hold the first source 104 of the first contiguous arrangement of wipes 105 in place in the chamber as the first contiguous arrangement of wipes 105 is pulled through the housing 102. In certain implementations, the first source 104 of the first contiguous arrangement of wipes 105 may form a roll and the support 121 may be an elongate shaft about which the first source 104 is rotatable to unwind the first contiguous arrangement of wipes 105 as tension is applied to at the end portion 115 of the first contiguous arrangement of wipes 105. For example, the support 121 may hold the first source 104, in the form of a roll, away from contact with the housing such that the roll may spin about the support 121 with relatively little resistance. A mechanical or rotational damper may also be used as appropriate to prevent freewheeling movement or unintended/undesired unwinding of the roll while not in use. For example, the support 121 may include a medium-friction rotational bearing, or a spring arm or the like may apply a moderate pressure to the circumference of the roll that inhibits free rotation of the roll while permitting rotation under tension applied to the end portion 115.

In general, the one or more guide surfaces 108 may be arranged relative to one another such that tension applied to the end portion 115 of the first contiguous arrangement of wipes 105 moves the first contiguous arrangement of wipes 105 from the first source 104 in the chamber 110, through the first liquid 106 in the first reservoir 112 and, ultimately, through the first opening 114. More specifically, at least a portion of the one or more guide surfaces 108 may be at least partially immersed in the first liquid 106 in the first reservoir 112 to direct the first contiguous arrangement of wipes 105 through the first liquid 106. Further, or instead, the one or more guide surfaces 108 may be arranged relative to one another such that the first contiguous arrangement of wipes 105 may be moved through the housing 102 with a tensile force that is unlikely to result in inadvertent tearing of the first contiguous arrangement of wipes 105 within the housing 102.

To reduce the likelihood of snagging—and, thus, inadvertently tearing—the first contiguous arrangement of wipes 105, the one or more guide surfaces 108 may be generally smooth surfaces. For example, the one or more guide surfaces 108 may include a lip (e.g. defined as part of an opening through a side wall of the first reservoir 112) over which the first contiguous arrangement of wipes 105 is fed from the chamber 110 to the first reservoir 112. For example, the one or more guide surfaces 108 may include one or more rollers rotatable to reduce friction imparted by the one or more guide surfaces 108 to the first contiguous arrangement of wipes 105. Thus, returning to the example of at least a portion of the one or more guide surfaces 108 extending below the first liquid 106 in the first reservoir 112, the one or more guide surfaces 108 may include a roller 123 at least partially immersed in the first liquid 106 in the first reservoir 112. Continuing with this example, the first contiguous arrangement of wipes 105 may be threaded in tension about the roller 123, and the roller 123 may be rotatable as the first contiguous arrangement of wipes 105 moves through the first liquid 106 in the first reservoir 112. In another aspect, the one or more guide surfaces 108 may include an arm or similar mechanism biased against the contiguous arrangement of wipes 105 to squeeze an excess of the activated fluid from the contiguous arrangement of wipes moving out of the reservoir.

In some implementations, the first contiguous arrangement of wipes 105 may include perforations 122, such as a transverse row of perforations, at intervals (e.g., uniform intervals) along a length of the first contiguous arrangement of wipes 105, or any other physical or mechanical treatment that facilitates separation of a sheet from the first contiguous arrangement of wipes 105 by a user while permitting sufficient tension to be applied along the wipes 105 to draw the wipes 105 along a feedpath from the first source 104 to the first opening 114. As should be appreciated, as each instance of the perforations 122 exits the first opening 114, the first contiguous arrangement of wipes 105 may be torn along the respective instance of the perforations 122 to form a discrete wipe that may be used to apply the first liquid 106 to a surface.

The first liquid 106 may include a sanitizer, a disinfectant, an antimicrobial agent, a degreaser, a cleaner, a detergent solution, or any combination of the foregoing known in the art, including formulations prepared according to general practices or custom requirements of a particular user or application. In one aspect, the first liquid 106 may be formulated according to considerations associated with one or more of storage, handling, or stability. Thus, in some instances, the first liquid 106 may be a first stable component of a volatile two-part liquid. Continuing with this example, the first contiguous arrangement of wipes 105 may be pre-wet with a second stable component (e.g., by at least partially immersing the first source 104 in the second stable component in the chamber) of the volatile two-part liquid such that movement of the first contiguous arrangement of wipes 105 through the first liquid 106 in the first reservoir 112 forms the volatile two-part liquid in the first contiguous arrangement of wipes 105 just prior to drawing the first contiguous arrangement of wipes 105 through the first opening 114 for use.

Having described movement of the first contiguous arrangement of wipes 105 through the housing 102 to facilitate locally introducing the first liquid 106 into the first contiguous arrangement of wipes 105 just prior to use, attention is now turned to other approaches to providing a liquid to wipes.

As an example, the dispenser 100 may include, for example, a second source 124 of a second contiguous arrangement of wipes 125 at least partially immersed in a second liquid 126 in a second reservoir 128. In use, the second contiguous arrangement of wipes 125 may be drawn directly from the second reservoir 128 and through an opening similar to the first opening 114 through which the first contiguous arrangement of wipes 105 is drawn. As should be appreciated, introduction of the second liquid 126 into the second contiguous arrangement of wipes 125 in this manner may be useful in applications that are not sensitive to concentration of the second liquid 126 in the second contiguous arrangement of wipes 125. In certain implementations, the first contiguous arrangement of wipes 105 may be formed of the same material as the second contiguous arrangement of wipes 125. However, this need not be the case in all instances and may depend on whether the wipes formed in each case are intended for use in sanitization or cleaning. For example, wipes intended for use with sanitizing fluid may be a silk-like material suitable for leaving behind an appropriate amount of sanitizer/disinfectant on a surface to meet requirements for dwell time while wipes intended for use with cleaning fluid may be formed of more absorbent material.

While certain approaches to locally introducing liquids into a contiguous arrangement of wipes have been described, other approaches to the local introduction of liquids into a contiguous arrangement of wipes are additionally or alternatively possible. For example, while formation of a liquid within the dispenser 100 has been described through combining components of the liquid, other approaches to forming a liquid within the dispenser 100 are additionally or alternatively possible.

Figure 2A:
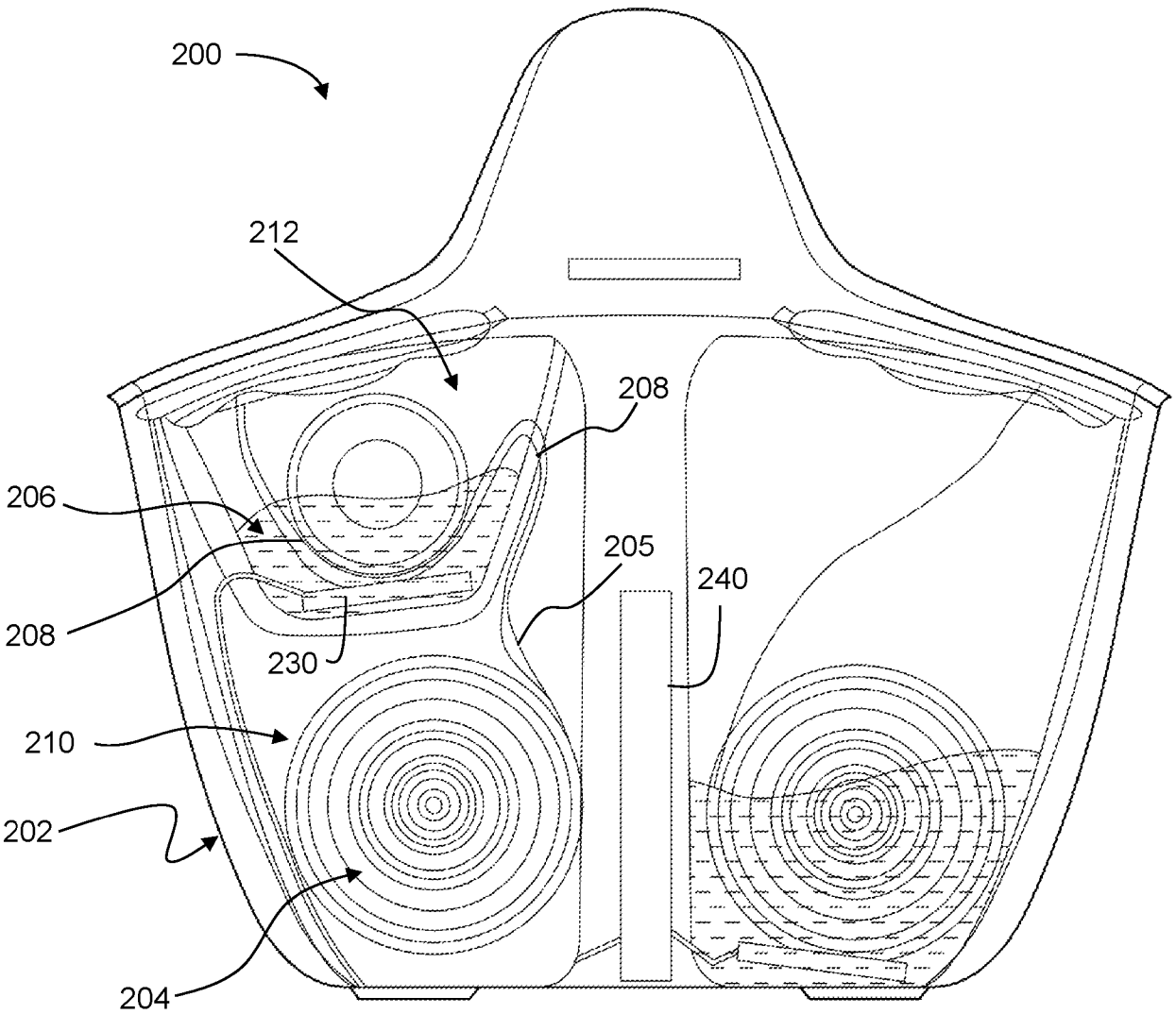
FIG. 2A shows a wipe dispenser.

For example, referring now to FIG. 2A, a dispenser 200 may include a housing 202, a first source 204 of a first contiguous arrangement of wipes 205, a first liquid 207, and one or more guide surfaces 208. In general, unless otherwise indicated or made clear from the context, elements in FIG. 2 having 200-series element numbers should be understood to be analogous to elements in FIGS. 1A-1E having 100-series element numbers and, for the sake of efficient explanation, are not described separately, except to highlight certain differences or emphasize features. Thus, for example, the housing 202 may define a chamber 210 and a first reservoir 212, and these should be understood to be analogous to the chamber 110 and the first reservoir 112, respectively, in FIGS. 1A-1E.

In use, as described in greater detail below, the first liquid 206 may be electrochemically activatable such that the delivery of electricity to the first liquid 206 may form the first liquid 206 into an activated fluid in the first reservoir 212. As the first contiguous arrangement of wipes 205 is drawn from the chamber 210 and through the activated fluid in the first reservoir 212, the activated fluid may be absorbed by the first contiguous arrangement of wipes 205 prior to being drawn through an opening (e.g., an opening analogous to the opening 114 described above with respect to FIGS. 1A-1E). Thus, because the activated fluid is formed in situ from the first liquid 206, the activated fluid may include one or more chemicals that have limited stability or present other challenges with respect to storage and handling. That is, stated differently, electrochemical activation of the first liquid 206 to form the activated fluid may facilitate forming wipes using a range of chemicals that would ordinarily pose challenges for delivery using wipes.

As depicted in FIG. 2A, different arrangements of wipes and liquids may be used. For example, the electrode system 230 may be positioned in a first reservoir 212 separate from the first source 204 of the contiguous arrangement of wipes 205. In another aspect, as depicted on a right side chamber of FIG. 2A, the source, e.g., a roll of wipes, may be wholly or partially immersed in a liquid, which may also include electrodes for use in electrochemical activation as described herein.

For example, electrochemical activation may be used with salts in an aqueous solution, including natural, common salts such as potassium carbonate, which may be electrochemically activated in solution to result in an electrochemically activated ("ECA") product that is safe and non-toxic, with properties of a cleaner, sanitizer, disinfectant, degreaser, antimicrobial and the like, as described by way of non-limiting example, in U.S. Pat. Pub. No. 2016/0024667 entitled "Electrochemical activation of water," incorporated herein by reference in its entirety. The on-demand creation of the ECA product from common salts and water can reduce the expenses of purchasing, storing and shipping large amounts of cleaners, sanitizers, degreasers, disinfectants, antimicrobials and the like, especially for high-volume industrial uses.

Figure 2B:
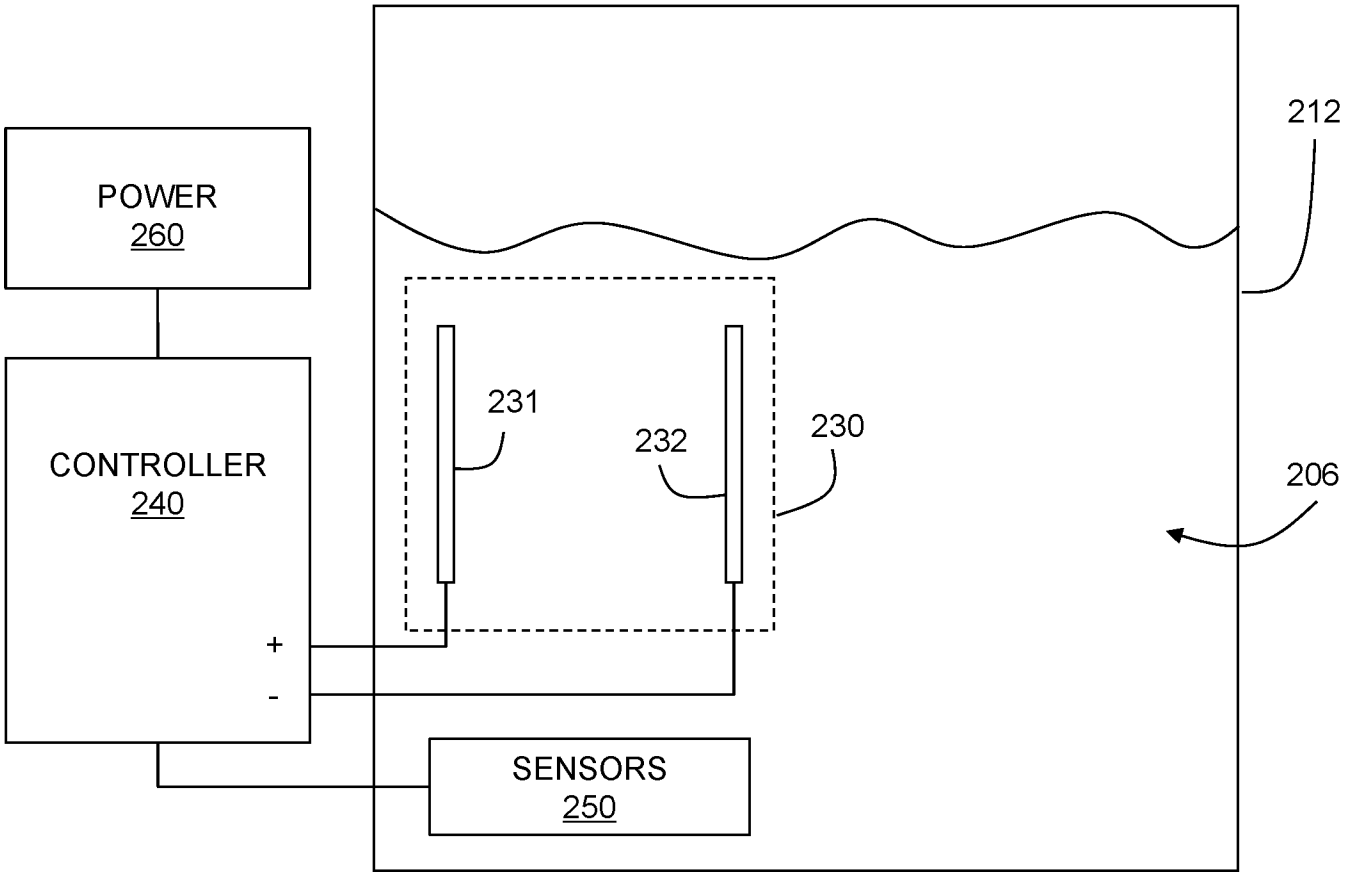
FIG. 2B depicts a reservoir with an electrode system and a controller.

FIG. 2B depicts a reservoir with an electrode system and a controller. As shown in FIG. 2B, in general, the first reservoir 212 (wipes not shown) may include an electrode system 230 coupled to the first reservoir 212, and a controller 240 that controls operation of the electrode system 230.

In general, the electrode system 230 may include a plurality of spaced apart electrodes, such as at least two electrodes 231, 232 (e.g., a positive and negative electrode) arranged to induce a current through the first liquid 206 in the first reservoir 212 in order to electrochemically activate the first liquid 206 and form an activated fluid. In embodiments, the at least two electrodes 231, 232 in the electrode system 230 may be made of a highly conductive, non-corrosive metal or made of titanium and have a platinum coating or made of titanium and have an iridium coating. It will be understood that the electrode system 230 may generally include two or more electrodes, which may be arranged according to well understood principles in a wide range of configurations to induce a current through the first liquid 206. The electrode system 230 may be adapted to be immersed in an aqueous salt solution such as the first liquid 206, and disposed with the at least two electrodes 231, 232 at a distance from one another, wherein upon the application of electricity to the first electrode 231 (+) and the second electrode 232 (−) induces a current for electrochemical activation. The distance between the at least two electrodes 231, 232 may be a fixed distance, or may be a variable distance that is automatically or manually controlled based on, e.g., available power, a targeted rate of electrochemical activation, the type of liquid being activated, and so forth.

The controller 240 may be electrically coupled to the electrode system 230, and may control operation of the electrode system 230 to electrochemically activate the first liquid 206, which may include applying a voltage across the electrode system 230. This may also or instead include pulsing the power delivered between the plurality of spaced apart electrodes, and/or periodically alternating the voltage to induce a reverse current across the at least two electrodes 231, 232. In another aspect, one or more sensors 250 may be disposed in contact with the first liquid 206 in the first reservoir 212, and the controller 240 may be configured to control the power to the electrode system 230 based on feedback from the one or more sensors 250, e.g., by increasing or decreasing power to the electrode system 230 based on a measured degree of electrochemical activation of the first liquid 206.

In general, the controller 240 may be responsive to various inputs to control the electrochemical activation ("ECA") process. For example, the controller 240 may be activated, e.g., by a switch, button or the like on the dispenser in order to manually activate the electrode system 230. In another aspect, the dispenser 200 may include a number of additional sensors, and the controller 240 may respond, e.g., to tension on, or movement of, the wipes to initiate activation of the electrode system 230. In another aspect, a distance between the at least two electrodes 231, 232 is adjustable, for example by automatically adjusting the distance in response to a measured voltage or current across the electrodes, or in response to a measured electrical property of the first liquid 206 that is indicative of a current degree of activation. Additional components such as an impeller, pump, mixer, or the like may be used to actively induce mixing and encourage more uniform activation of the first liquid 206. The controller 240 may be powered by a power source 260 such as line power or a battery, or any other suitable power source, and may be configured to provide a flow of electricity between the plurality of spaced apart electrodes in the electrode system 230 to form an activated fluid as contemplated herein.

The first liquid 206 may, for example, include one or more of a sanitizing solution, a disinfecting solution, a cleaning solution, a degreasing solution, and an antimicrobial solution. The first liquid 206 may also or instead include a salt that is, e.g., potassium carbonate, sodium chloride or a mixture of sodium chloride and citric acid, acetic acid, or some other additive. The first liquid 206 may also or instead contain at least one of HOCl or KOH. The first liquid 206 may also or instead include ionized water. An active species of the first liquid 206, e.g., an active agent upon electrochemical activation, may include at least one of OH— and Cl—.

Figure 3:
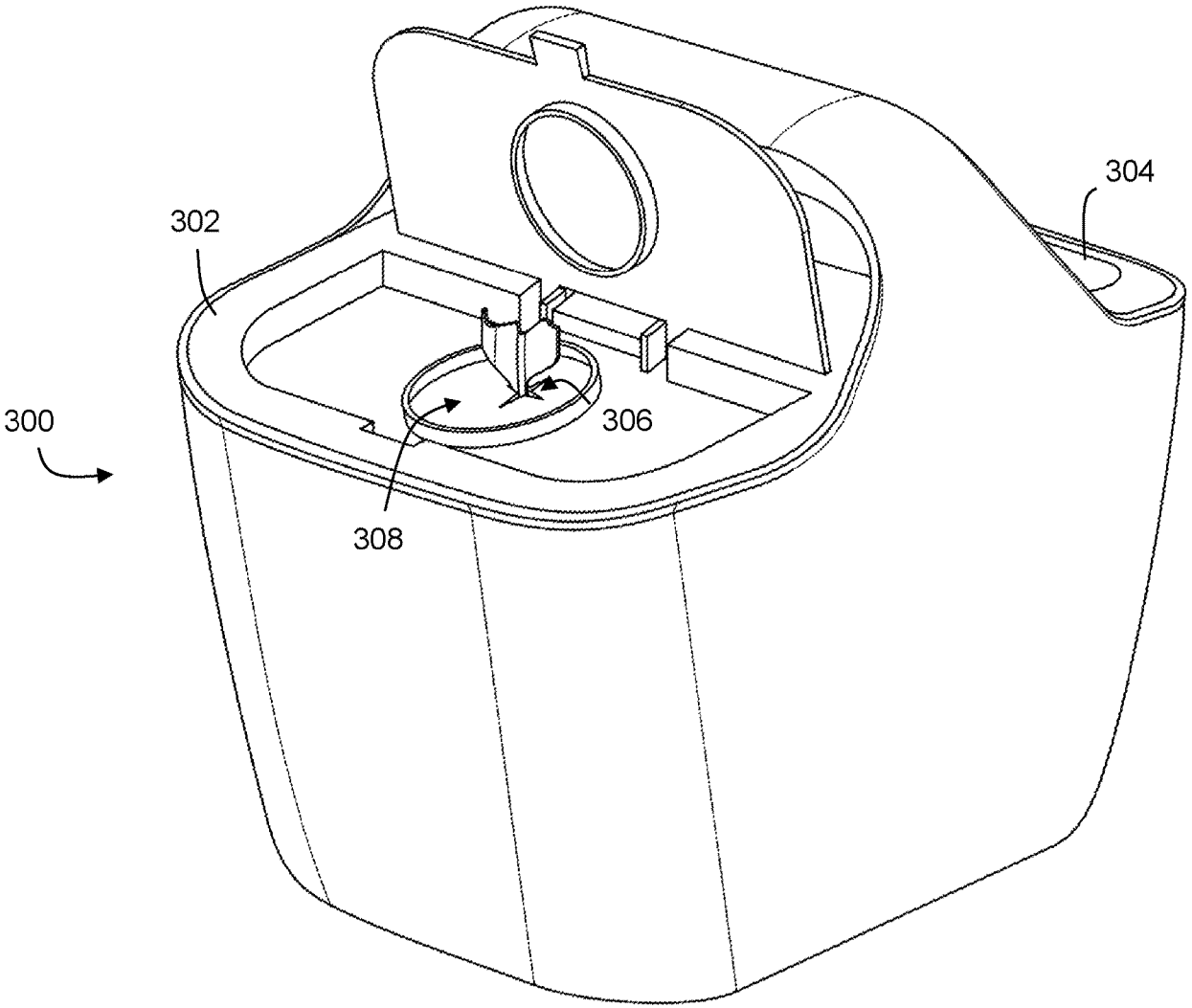
FIG. 3 shows a perspective view of a wipe dispenser.

FIG. 3 shows a wipe dispenser. In general, the dispenser 300 may be any of the dispensers described herein, and may include a plurality of modular dispensers 302, 304 that are independently removable, serviceable and replaceable. The dispenser 300 may include a cross or x-shaped opening as depicted in FIG. 3. While a sheet-width, linear opening is depicted in, e.g., FIG. 1B, it will be understood that the opening any shape or combination of shapes suitable for retaining an end sheet of a contiguous arrangement of wipes may be used as the opening 306 described herein. In general, the opening 306 may be formed for a number of purposes. For example, the opening 306 may retain tension on the contiguous arrangement of wipes within the dispenser 300, while also retaining the wipes with sufficient tenacity to permit removal of an individual, exposed sheet from the dispenser. Similarly, the opening 306 may apply a suitable pressure to a sheet while traveling there through to press or squeeze excess fluid from the sheet, which excess fluid can be captured in a well 308 or the like and returned to the dispenser 300 for subsequent use.

Figure 4:
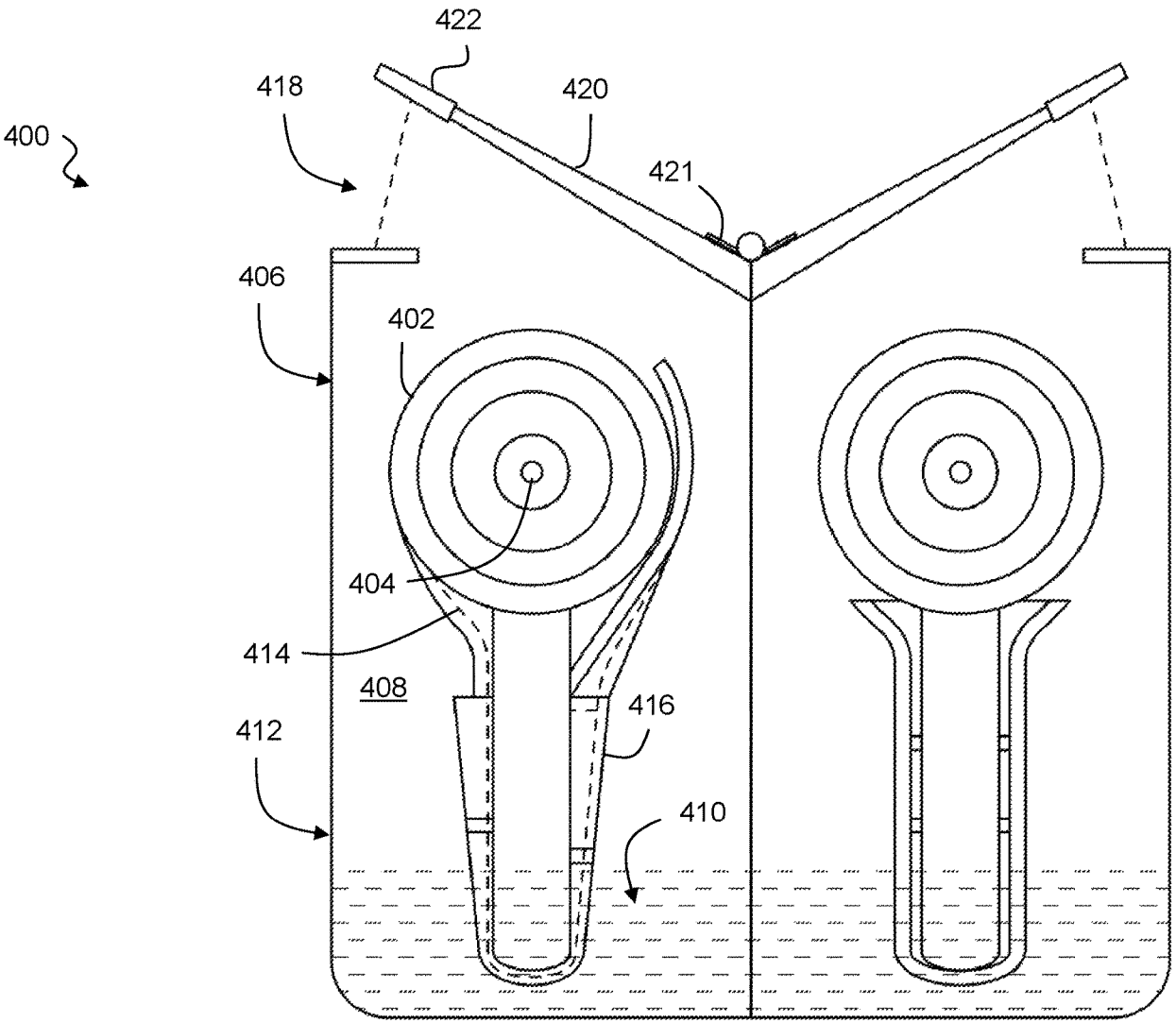
FIG. 4 shows a cross-section of a wipe dispenser.

FIG. 4 shows a cross section of a wipe dispenser. As shown in the embodiment of FIG. 4, the dispenser 400 may be configured with a source 402 of wipes such as a roll retained on an axle 404 or the like in an upper portion 406 of a chamber 408, with a liquid 410 retained in a reservoir in a lower portion 412 of the chamber 408.

In this embodiment, the wipes 414 may be drawn through one or more guides 416 along a path through the liquid 410 and out to an opening 418 for the dispenser 400. The one or more guides 416, may perform a variety of functions as described herein such as defining the feedpath for the wipes 414 through the liquid 410, maintaining appropriate tension along the feedpath, removing excess fluid from the wipes 414 as they are withdrawn from the chamber 408, and so forth. In embodiments, the dispenser 400 may also include a lid 420 that is, e.g., loaded by a spring 421 in a closed position (to seal the chamber 408 when not in use), with a rubber squeegee 422 or the like on an end that squeezes excess liquid from wipes 414 as they are withdrawn, and recycles the excess liquid back into the reservoir.

Figure 5:
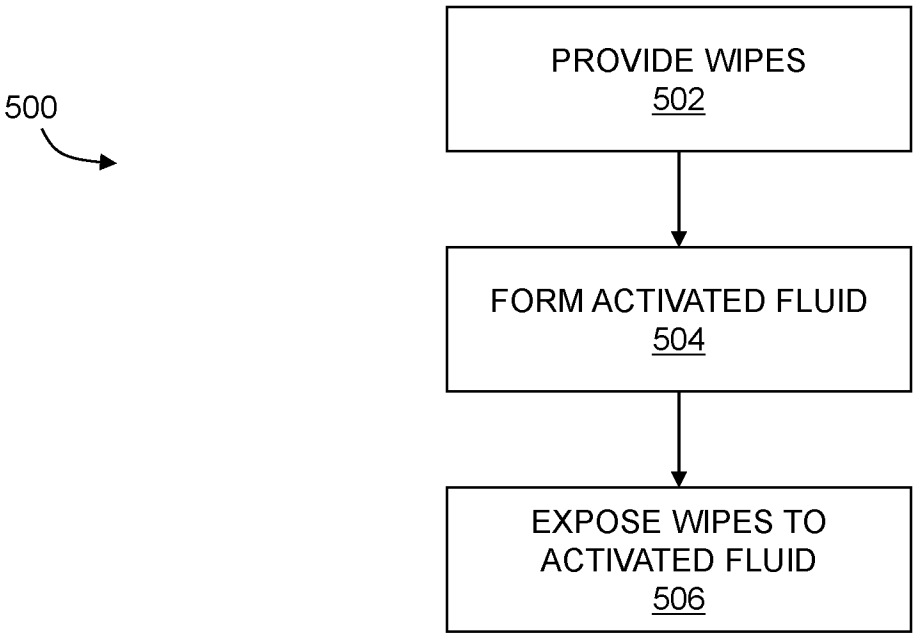
FIG. 5 shows a method for dispensing treated wipes.

FIG. 5 shows a method for dispensing treated wipes.

As shown in step 502, the method 500 may include providing a source of wipes. This may include providing wipes in any of the form factors described herein, or any other form factor suitable for distribution of individual wipes containing an active agent from a dispenser. For example, this may include providing a source of a contiguous arrangement of wipes in a housing. The wipes may be sequentially engaged with one another in the contiguous arrangement and the wipes may be formed of an absorbent material suitable for retaining an active agent such as a cleaning or sanitizing solution, or any of the other liquid products described herein.

As shown in step 504, the method 500 may include forming an activated fluid. This may, for example, include activating a liquid as described above, such as by activating a liquid in a reservoir defined by the housing to form the liquid into an activated fluid. The activated fluid may be a sanitizing solution. The activated fluid may also or instead include a cleaning solution, a degreasing solution, and so forth.

A variety of techniques may be used to activate the liquid. In one aspect, activating the liquid in the reservoir may include electrochemically activating the first liquid to form an activated fluid, such as by providing a flow of electricity through the liquid in the reservoir. For example, where the liquid in the reservoir is an aqueous solution including at least one salt, electrochemically activating the first liquid in the reservoir may include inducing an electrolysis reaction with the flow of electricity. As noted above, providing the flow of electricity may include providing a steady flow of electricity (e.g., a DC current), periodically reversing polarity, varying the flow of electricity (either in a predetermined open loop manner, or in response to sensor feedback), pulsing the flow of electricity, or otherwise controlling the flow of electricity through the liquid in the reservoir.

In another aspect, activating the liquid may include exposing the liquid to a second liquid carried on the at least one portion of the contiguous arrangement of wipes drawn through the first liquid. Thus, for example, in the embodiment described above in FIG. 4, the roll of wipes suspended above an activating solution may itself be partially or wholly submerged in a second solution that combines with the activating solution to produce the activated fluid. In another aspect, the contiguous arrangement of wipes may be drawn through two or more consecutive reservoirs of fluids in order to treat the wipes with a sequence of fluids that produces an activated fluid within wipes as they are withdrawn from the housing.

As shown in step 506, the method 500 may include exposing the wipes to the activated fluid, for example by drawing at least one portion of the contiguous arrangement of the wipes through the activated fluid in the reservoir. In one aspect, a source of the contiguous arrangement of the wipes is supported in a position outside of the liquid, and at least one portion of the contiguous arrangement of the wipes is drawn through the liquid from the position outside of the first liquid, for example according to the feedpath illustrated in the left-hand chamber of FIG. 2A.

Exposing the wipes to the activated fluid may also or instead include extracting one of the wipes through an opening in the housing and tearing the wipe, e.g., along a transverse row of perforations or the like, to remove the wipe from the contiguous arrangement for use. For example, drawing the at least one portion of the contiguous arrangement of the wipes through the activated fluid may include pulling an end portion of the contiguous arrangement of the wipes through an opening defined by the housing. This action of pulling through an opening may also squeeze the at least one portion of the contiguous arrangement of wipes to remove an excess amount of the activated fluid from the at least one portion of the contiguous arrangement.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A method for dispensing treated wipes, the method comprising:

providing a source of a contiguous arrangement of wipes in a housing, the wipes sequentially engaged with one another in the contiguous arrangement and the wipes formed of an absorbent material;

activating a liquid in a reservoir defined by the housing to form the liquid into an activated fluid; and drawing at least one portion of the contiguous arrangement of the wipes through the activated fluid in the reservoir; wherein one or more guide surfaces includes an arm biased against the contiguous arrangement of wipes to squeeze an excess of the activated fluid from the contiguous arrangement of wipes moving out of the reservoir.

2. The method of claim 1 wherein the activated fluid is at least one of a sanitizing solution and a disinfecting solution.

3. The method of claim 1 wherein activating the liquid in the reservoir includes electrochemically activating the liquid to form the activated fluid.

4. The method of claim 3 wherein electrochemically activating the liquid includes providing a flow of electricity through the liquid in the reservoir.

5. The method of claim 4 wherein providing the flow of electricity through the liquid in the reservoir includes pulsing the flow of electricity through the liquid in the reservoir.

6. The method of claim 3 wherein the liquid in the reservoir is an aqueous solution including at least one salt, and electrochemically activating the liquid in the reservoir includes an electrolysis reaction.

7. The method of claim 1 wherein activating the liquid includes exposing the liquid to a second liquid carried on the at least one portion of the contiguous arrangement of wipes drawn through the liquid.

8. The method of claim 1 wherein the source of the contiguous arrangement of the wipes is supported in a position outside of the liquid, and wherein at least one portion of the contiguous arrangement of the wipes is drawn through the liquid from the position outside of the liquid.

9. The method of claim 1 wherein drawing the at least one portion of the contiguous arrangement of the wipes through the activated fluid includes pulling an end portion of the contiguous arrangement of the wipes through an opening defined by the housing.

10. The method of claim 9 wherein pulling the end portion of the contiguous arrangement of the wipes through the opening squeezes the at least one portion of the contiguous arrangement to remove an excess amount of the activated fluid from the at least one portion of the contiguous arrangement.

11. A system for dispensing treated wipes, the system comprising:

a housing defining a chamber, a reservoir, and an opening;

a source of a contiguous arrangement of wipes in the chamber;

a liquid in the reservoir;

an electrode system including a plurality of spaced apart electrodes within the reservoir and positioned relative to one another to facilitate a flow of electricity through the liquid to form an activated fluid;

a controller coupled to the electrode system and configured to provide the flow of electricity between the plurality of spaced apart electrodes to form the activated fluid; and one or more guide surfaces arranged to guide the contiguous arrangement of wipes from the source in the chamber, through the liquid in the reservoir, and out of the housing via the opening; wherein the one or more guide surfaces includes an arm biased against the contiguous arrangement of wipes to squeeze an excess of the activated fluid from the contiguous arrangement of wipes moving out of the reservoir.

12. The system of claim 11 wherein the source of the contiguous arrangement of the wipes includes one or more of a roll or a stack of the wipes.

13. The system of claim 11 wherein the contiguous arrangement of wipes is perforated at intervals along a length of the contiguous arrangement of wipes.

14. The system of claim 11 further comprising one or more sensors, the one or more sensors in fluid communication with the liquid in the reservoir, and the controller configured to control a power driven between the plurality of spaced apart electrodes based on feedback from the one or more sensors.

15. The system of claim 14 wherein the controller is configured to pulse the power driven between the plurality of spaced apart electrodes.

16. The system of claim 11 wherein the plurality of spaced apart electrodes are spaced at a fixed distance relative to one another.

17. The system of claim 11 wherein the one or more guide surfaces extends below the liquid in the reservoir.

18. The system of claim 11 wherein the one or more guide surfaces includes a roller, the contiguous arrangement of wipes is threaded in tension around the roller, and the roller is rotatable as the contiguous arrangement of wipes moves through the liquid in the reservoir.

* * * * *